US006189152B1

(12) United States Patent
Lofton

(10) Patent No.: US 6,189,152 B1
(45) Date of Patent: Feb. 20, 2001

(54) BATHING CAP

(76) Inventor: Made B. Lofton, 5003 Old Federal Rd., Louisville, KY (US) 40207

( * ) Notice: Under 35 U.S.C. 154(b), the term of this patent shall be extended for 0 days.

(21) Appl. No.: 09/539,675

(22) Filed: Mar. 30, 2000

Related U.S. Application Data

(60) Provisional application No. 60/128,129, filed on Apr. 7, 1999.

(51) Int. Cl.[7] ..... A42B 19/02

(52) U.S. Cl. ..... 2/171; 2/174

(58) Field of Search ..... 2/171, 172, 184, 2/174, 202, 203, 204, 207, 208, 209, 200.1, 200.2

(56) References Cited

U.S. PATENT DOCUMENTS

| | | | | |
|---|---|---|---|---|
| D. 44,783 | | 10/1913 | Guinzburg . | |
| D. 44,840 | | 11/1913 | Guinzburg . | |
| D. 46,603 | | 10/1914 | Murray . | |
| D. 65,614 | | 9/1924 | McCoy . | |
| D. 81,816 | | 8/1930 | Spoonemore . | |
| D. 129,012 | | 8/1941 | Witkins . | |
| 335,300 | | 2/1886 | Ovenu et al. . | |
| 770,338 | | 9/1904 | Tooher . | |
| 1,144,121 | | 6/1915 | Guinzburg . | |
| 1,156,238 | | 10/1915 | Litchfield . | |
| 1,541,810 | | 6/1925 | Hamilton . | |
| 1,742,314 | | 1/1930 | Husman . | |
| 1,819,558 | | 8/1931 | Husman . | |
| 1,874,879 | * | 8/1932 | Brosch | 2/171 |
| 1,920,387 | | 8/1933 | Harper . | |
| 2,147,504 | | 2/1939 | Spanel . | |
| 2,229,825 | | 1/1941 | Stachel . | |
| 2,417,323 | | 3/1947 | Richards et al. . | |
| 2,647,259 | | 8/1953 | Hutton . | |
| 2,665,427 | * | 1/1954 | Street et al. | 2/171 |
| 2,704,366 | * | 3/1955 | Arnold | 2/171 |
| 2,869,133 | | 1/1959 | Garbellano . | |
| 3,076,972 | * | 2/1963 | Prophet et al. | 2/171 |
| 3,979,777 | | 9/1976 | Gregg . | |
| 5,542,127 | * | 8/1996 | Bezanis | 2/172 |

* cited by examiner

*Primary Examiner*—Gloria M. Hale
(74) *Attorney, Agent, or Firm*—Theresa Fritz Camoriano; Camoriano and Associates

(57) ABSTRACT

A bathing cap includes lower extensions which can wrap around the sides of the cap, cross at the top, wrap down around the sides, and tie at the nape of the neck. Preferably, the portions of the cap adjacent the cheeks project forward of the normal hairline.

4 Claims, 2 Drawing Sheets

BATHING CAP

This application claims priority from U.S. Provisional Application Ser. No. 60/128,129, filed Apr. 7, 1999.

BACKGROUND OF THE INVENTION

The present invention relates to bathing caps, and, in particular, to a bathing cap that includes elongated extensions that can be wrapped around the person's head to help secure the cap in place and prevent water from seeping around the edge, thus decreasing the potential for the hair to get wet and preventing water from entering the wearer's ears.

DESCRIPTION OF THE PREFERRED EMBODIMENTS

Figure 1:
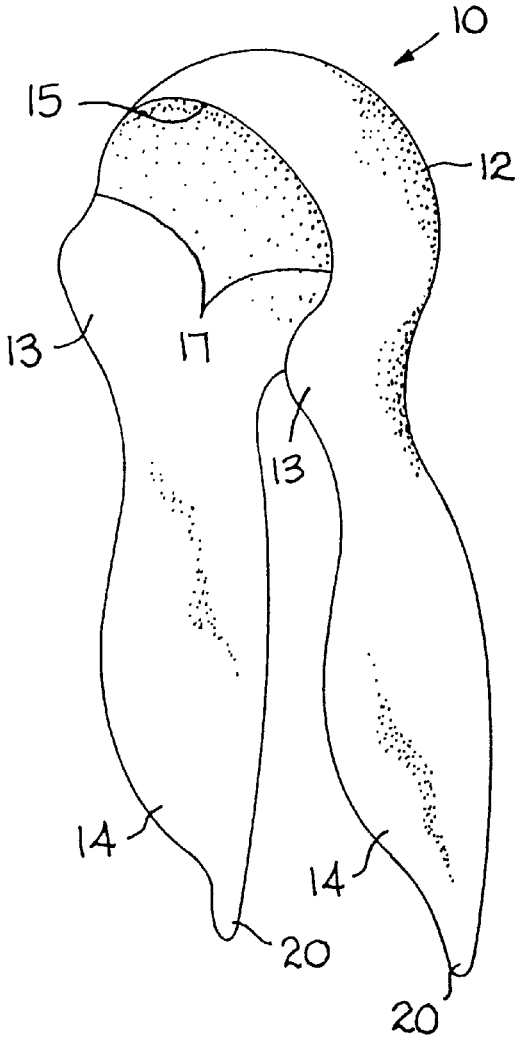
FIG. 1 is a front perspective view of a bathing cap made in accordance with the present invention.
Figure 2:
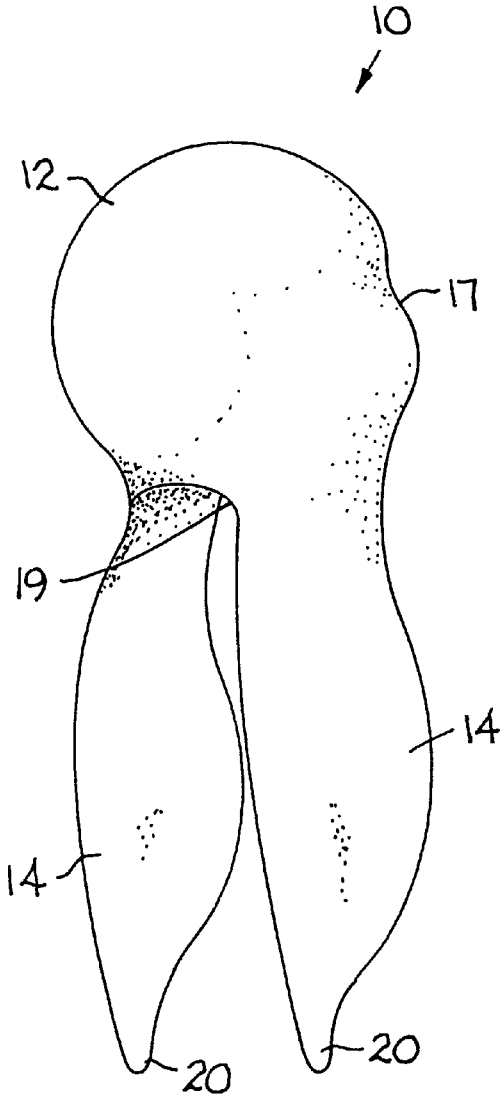
FIG. 2 is a rear perspective view of the cap of FIG. 1.
Figure 3:
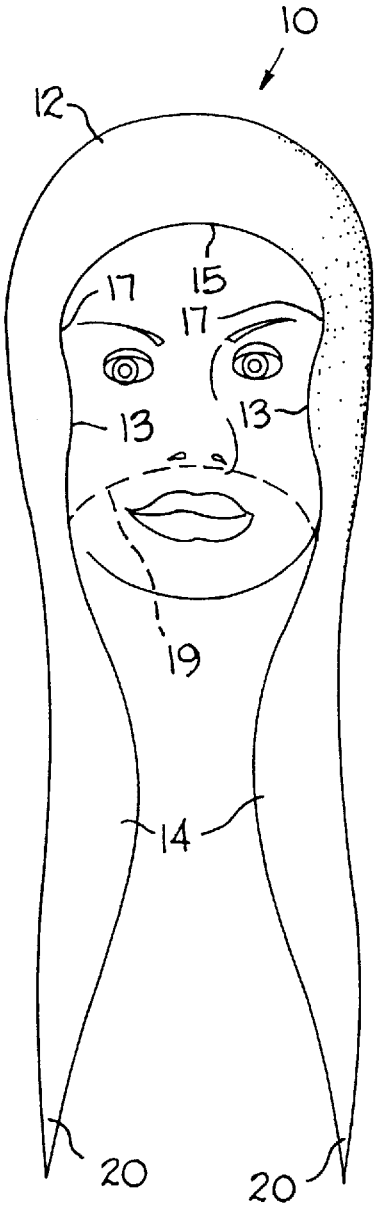
FIG. 3 is a front view of a person wearing the cap of FIG. 1 untied.
Figure 4:
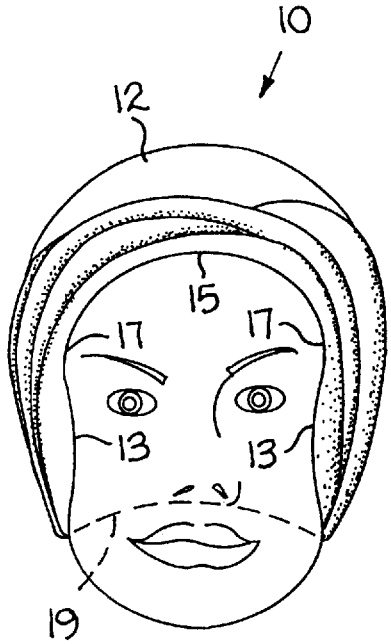
FIG. 4 is the same view as FIG. 3 but after the cap is tied.
Figure 5:
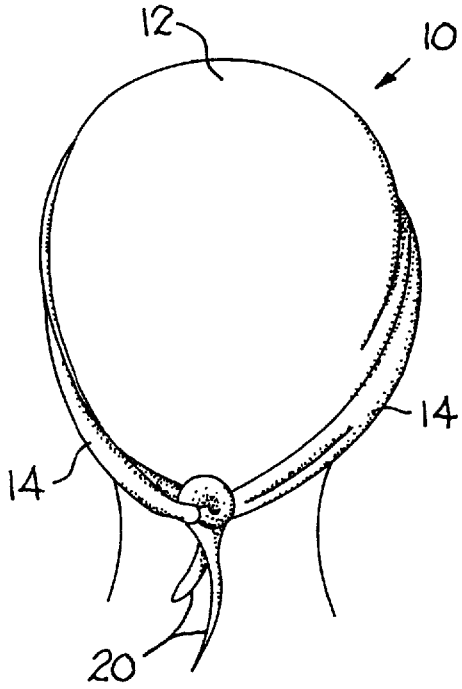
FIG. 5 is a rear view of the person and tied cap of FIG. 4.

The bathing cap 10 shown in FIGS. 1–5 is made up of three main portions—a cap or head-covering portion 12, which surrounds the hairline and ears of the wearer, and left and right tie portions or extensions 14. The cap or head-covering portion 12 defines an upper margin or border 15, adjacent the top of the wearer's forehead, left and right side margins or borders 17, which generally extend along the hairline, except for portions 13, which project forward in the cheek and ear area, and a lower rear margin or border 19, which extends along the nape of the neck. The height of the cap or head-covering portion 12 is the distance from the nape of the neck or lower margin 19 to the upper margin 15. The tie portions or extensions 14 project downwardly from the lower part of the head-covering portion 12, between the side borders 17 and the lower border 19. These extensions 14 are relatively wide in the middle and narrower at their free ends to facilitate tying them together. The extensions are preferably greater than twice the height of the head-covering portion 12 so that they can extend along their respective sides of the person's face, cross at the top of the head, extend down along the other sides, and tie in the back adjacent the lower border 19, as shown in FIGS. 4 and 5. The cap portion 12 and tie portions 14 preferably are formed from an elastic, impermeable material, such as latex rubber, coated fabric, or another suitable material that will keep water out of the wearer's hair and ears and will stretch sufficiently to conform to the shape of the wearer's head.

The forward projections 13 in the cheek and ear area provide ample surface area over which the extensions 14 can wrap to secure the cap and especially to prevent water from entering the wearer's ears. Wrapping the tie portions 14 along the sides 17, top 15, and lower edge 19 of the head-covering portion 12 helps secure the cap 10 on the person's head and helps prevent leaking. The top and side borders 15, 17 of the head-covering portion are double-wrapped in this manner, and the lower edge 19 is at least single-wrapped, thereby providing substantial protection against leakage. The narrower end portions 20 on the ties 14 makes it easier to tie them, while still providing ample material to lie against the sides of the face.

It will be obvious to those skilled in the art that modifications may be made to the embodiment described above without departing from the scope of the present invention.

What is claimed is:

1. A bathing cap, comprising:

a head-covering portion, generally following the shape of a normal hairline but extending forward of the hairline in the cheek area, and defining an upper margin, left and right side margins, and a lower margin;

left and right tie portions extending between the side margins and lower margin, each of said tie portions wrapping along its respective side margin, along the upper margin, and then along the other side margin, and the two tie portions tying together at the lower margin, so as to double wrap the upper margins and side margin and at least single wrap the lower margin; wherein said cap is made of an elastic, water-impermeable material.

2. A bathing cap, comprising:

a head-covering portion made of a water resistant material and shaped to cover a normal human hairline, defining an upper border, left and right side borders, and a lower border; and left and right lower extensions from said head-covering portion, each of said extensions being greater than two times the length from the upper border to the lower border so that said each of lower extensions can wrap along its respective side border, along the upper border, down along the other side border, and be anchored along the lower border, and further comprising forwardly-projecting portions from said head-covering portion along said left and right side borders, adjacent a normal human cheekline, so as to provide ample surface area over which said lower extensions can wrap to provide especially secure protection to the wearer's ears.

3. A bathing cap, comprising:

a water resistant covering portion shaped to cover a normal human hairline from the top of the forehead to the nape of the neck;

left and right forwardly-projecting cheek portions; and left and right lower extensions, said lower extensions being long enough to wrap along the cheek portions, around the top of the top of the forehead, back down along the opposite cheek portions, and to be anchored at the nape of the neck.

4. A bathing cap as recited in claim 3, wherein said left and right lower extensions are long enough to be anchored at the nape of the neck by tying them together.

* * * * *

UNITED STATES PATENT AND TRADEMARK OFFICE

CERTIFICATE OF CORRECTION

PATENT NO. : 6,189,152 B1
DATED : February 20, 2001
INVENTOR(S) : Maude B. Lofton It is certified that error appears in the above-identified patent and that said Letters Patent is hereby corrected as shown below:

Title page,
Item [75], Inventor, delete "Made B. Lofton" and insert -- Maude B. Lofton --.

Signed and Sealed this

Twentieth Day of December, 2005

JON W. DUDAS
*Director of the United States Patent and Trademark Office*